US007669254B2

(12) United States Patent
Mortimer-McKenzie

(10) Patent No.: US 7,669,254 B2
(45) Date of Patent: Mar. 2, 2010

(54) CONVERTIBLE FURNITURE

(76) Inventor: Kenya N. Mortimer-McKenzie, P.O. Box N-10739, Nassau (BS)

( * ) Notice: Subject to any disclaimer, the term of this patent is extended or adjusted under 35 U.S.C. 154(b) by 0 days.

(21) Appl. No.: 12/010,638

(22) Filed: Jan. 28, 2008

(65) Prior Publication Data

US 2009/0188037 A1 Jul. 30, 2009

(51) Int. Cl.
*A47C 17/04* (2006.01)

(52) U.S. Cl. ..... 5/4; 5/2.1; 5/18.1

(58) Field of Classification Search ..... 5/2.1, 5/3, 4, 152, 159.1, 18.1, 52
See application file for complete search history.

(56) References Cited

U.S. PATENT DOCUMENTS

| | | | | |
|---|---|---|---|---|
| 1,825,055 | A | 9/1931 | De Bretteville | |
| 2,307,908 | A | 1/1943 | Campbell | |
| 2,592,504 | A | 4/1952 | Woller | |
| 3,581,318 | A * | 6/1971 | Kroupa | 5/2.1 |
| 3,910,630 | A | 10/1975 | Runyon et al. | |
| D286,708 | S | 11/1986 | Heinson | |
| 5,327,591 | A | 7/1994 | Fireman et al. | |
| 6,668,395 | B1 | 12/2003 | Chen | |
| D488,311 | S | 4/2004 | Boydak | |
| 2002/0108174 | A1 | 8/2002 | Widly et al. | |
| 2003/0046760 | A1 | 3/2003 | Chadbourn | |
| 2004/0093669 | A1 | 5/2004 | Arason et al. | |
| 2004/0158921 | A1 | 8/2004 | Pine | |
| 2007/0143919 | A1 | 6/2007 | Erdman | |

FOREIGN PATENT DOCUMENTS

| | | |
|---|---|---|
| EP | 1 230 877 A1 | 8/2002 |
| GB | 1 339 190 | 11/1973 |

OTHER PUBLICATIONS

Daybed, sleepersofa.com website: http://www.sleepersofa.com/asp/show_detail.asp?sku=ND1396&refid=MP68- ND1396, 7 pages printed from the Internet on Sep. 2, 2007.

* cited by examiner

*Primary Examiner*—Fredrick Conley
(74) *Attorney, Agent, or Firm*—Richard C. Litman

(57) ABSTRACT

The convertible furniture includes an elongate central bench section. A subframe is provided having an elongate planar member with load-bearing upright support members supporting arm rests or back rests extending upward at opposite ends of the elongate planar member. The central bench section is disposed atop the upright support members. Two lateral extension sections are pivotally attached to opposite edges of the bench section so that the lateral extension sections independently swing out from the central bench section to define a bed frame. Each of the lateral extension sections includes extendable support legs, which provide stability to the respective lateral extension section when extended to the bed frame configuration. Removable mattresses are provided for each section of the furniture. The mattresses are stored on the subframe and hidden from view when the extension sections are retracted. Placing a mattress on the bench section converts the bench to a chaise.

7 Claims, 6 Drawing Sheets

CONVERTIBLE FURNITURE

BACKGROUND OF THE INVENTION

1. Field of the Invention

The present invention relates to furniture, and more specifically to convertible furniture that is adaptable for use as a bed, a bench, or a chaise.

2. Description of the Related Art

Furniture that is convertible between a bed position and a couch position is known in the art. The conventional sofa bed allows users to maximize the use of a limited living space, such as a studio or small apartment, by reducing the space dedicated for furniture. Instead of requiring a space in the apartment dedicated solely for the user's bed and another space in the apartment dedicated solely for the user's couch or sofa, the sofa bed allows the user to eliminate one of the aforementioned dedicated furniture spaces, thereby providing the user with increased living space.

Nevertheless, such versatility is usually achieved only by providing a heavy-duty frame that sometimes requires arduous effort to effect the conversion, and has considerable weight, making the sofa bed difficult to move or transport. Further, it would be desirable to provide convertible furniture that has greater versatility to replace additional articles of furniture that would otherwise occupy living space. Thus, convertible furniture solving the aforementioned problems is desired.

SUMMARY OF THE INVENTION

The convertible furniture includes an elongate central bench section. A subframe is provided having an elongate planar member with load-bearing upright support members supporting arm rests or back rests extending upward at opposite ends of the elongate planar member. The central bench section is disposed atop the upright support members. Two lateral extension sections are pivotally attached to opposite edges of the bench section so that the lateral extension sections independently swing out from the central bench section to define a bed frame. Each of the lateral extension sections includes extendable support legs, which provide stability to the respective lateral extension section when extended to the bed frame configuration. Removable mattresses are provided for each section of the furniture. The mattresses are stored on the subframe and hidden from view when the extension sections are retracted. Placing a mattress on the bench section converts the bench to a chaise.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
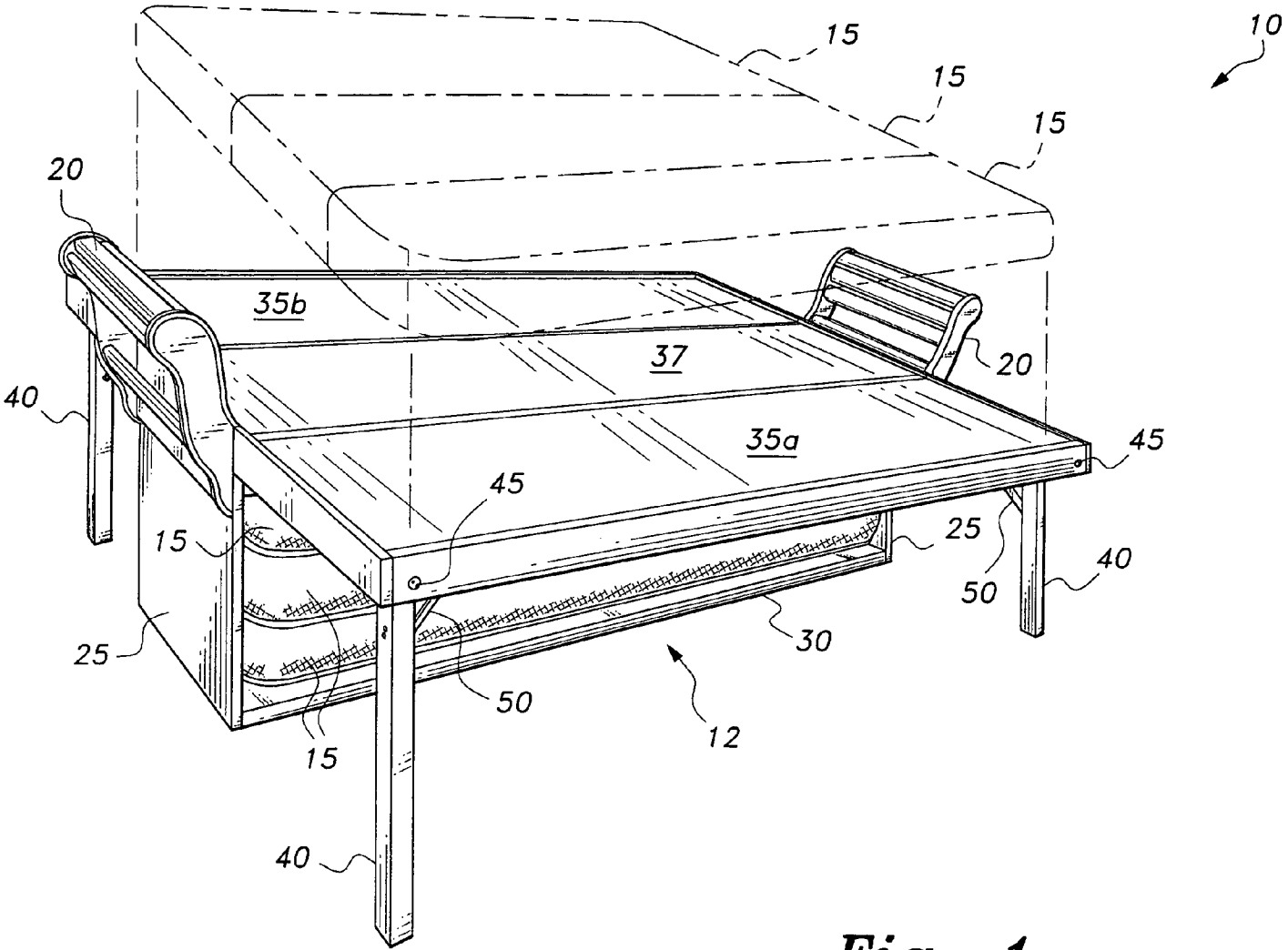
FIG. 1 is a perspective view of an article of convertible furniture according to the present invention, shown configured for use as a bed with the mattresses disposed below the bed frame.

As shown in FIGS. 1-4, the present invention relates to an article of convertible furniture 10 including an elongate central bench section 37 having a planar surface. A subframe 12 is provided having an elongate planar member 30 joined by load bearing support members 25 that extend upward from either longitudinal end of the elongate planar member 30. The central bench section 37 is disposed atop the subframe 12.

Figure 2:
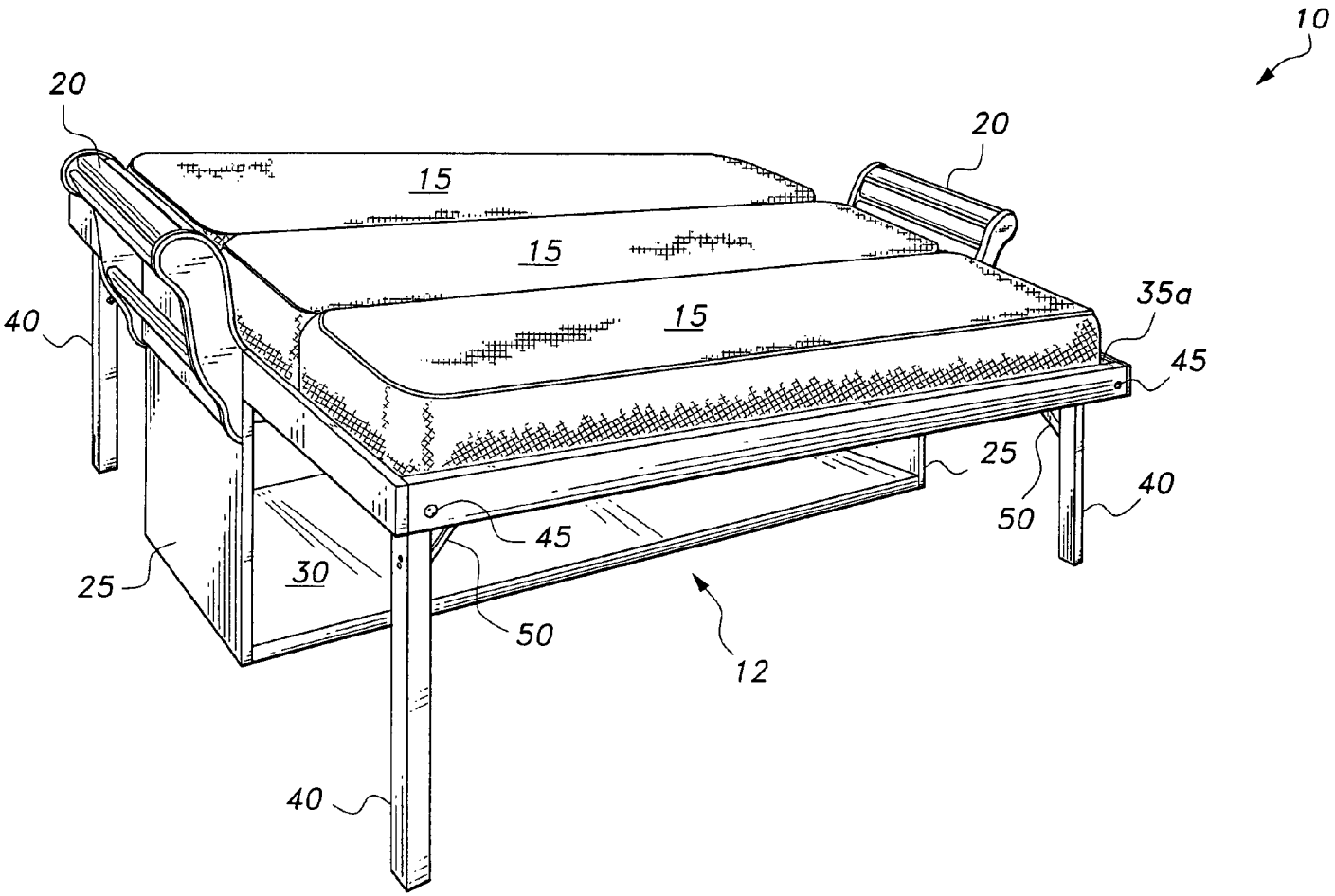
FIG. 2 is a perspective view of the article of convertible furniture of FIG. 1, shown configured for use as a bed with the mattresses disposed on top of the bed frame.
Figure 3:
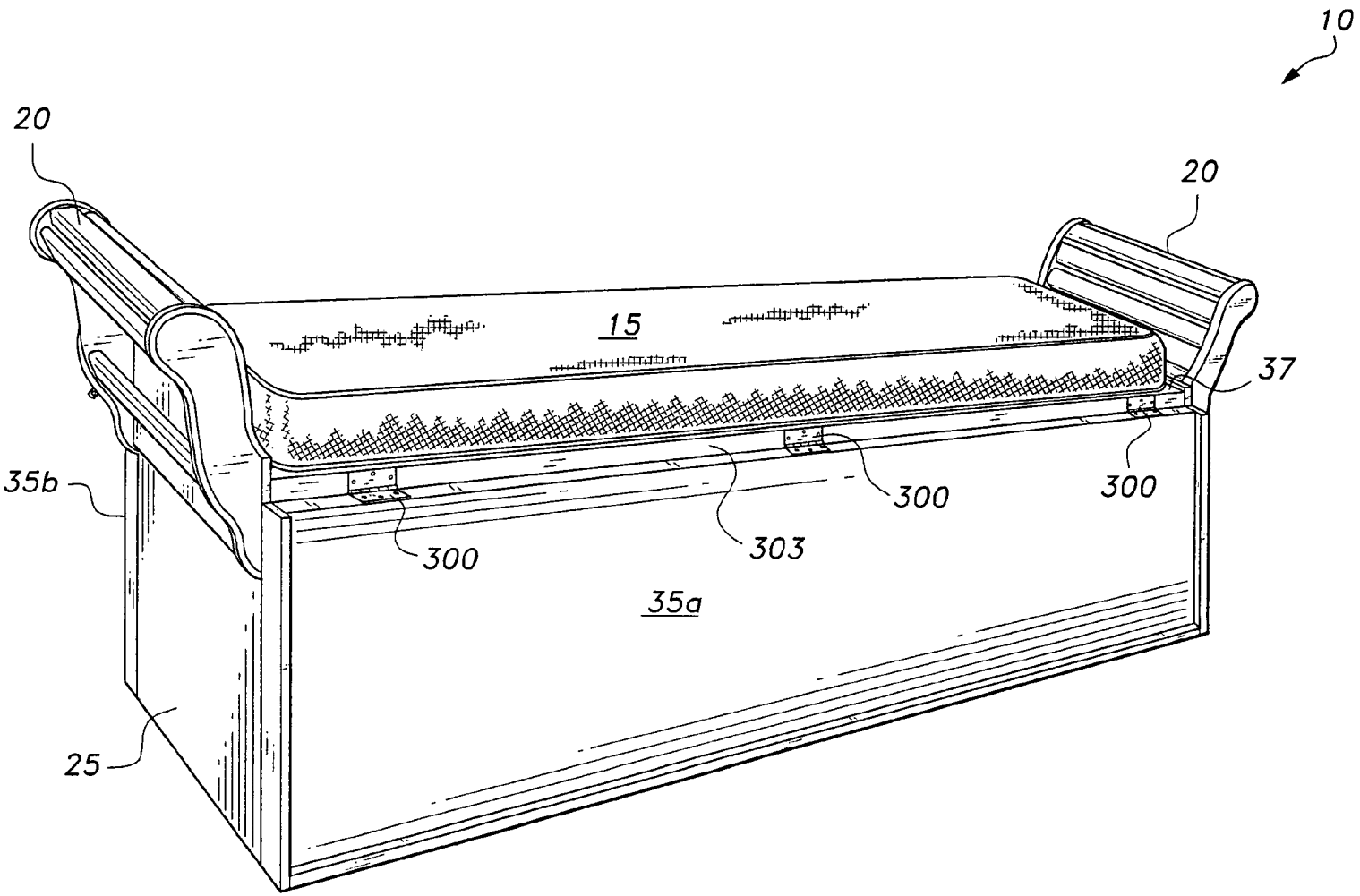
FIG. 3 is a perspective view of the article of convertible furniture of FIG. 1, shown configured for use as a chaise.
Figure 4:
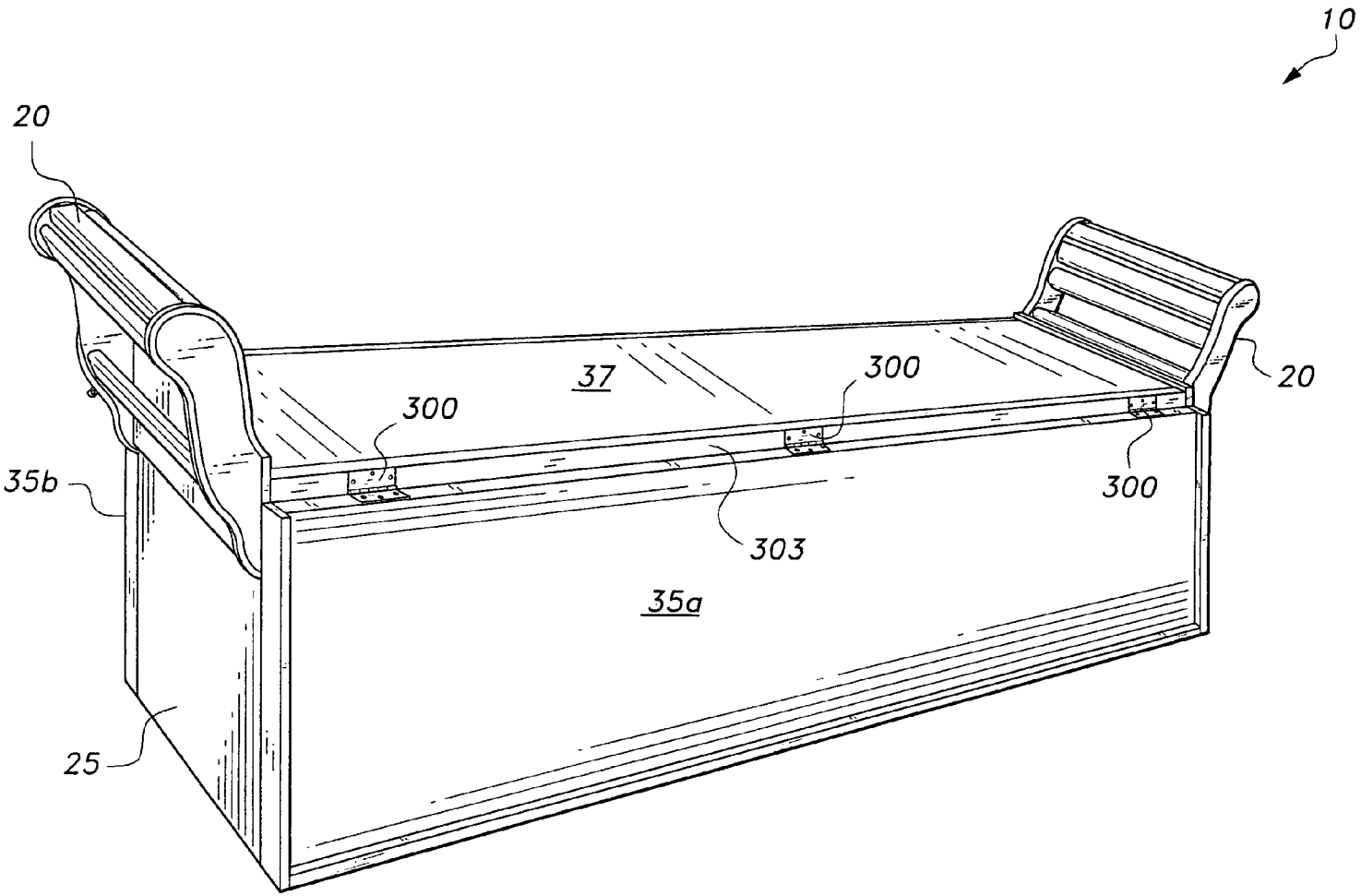
FIG. 4 is a perspective view of the article of convertible furniture of FIG. 1, shown configured for use as a bench.
Figure 5:
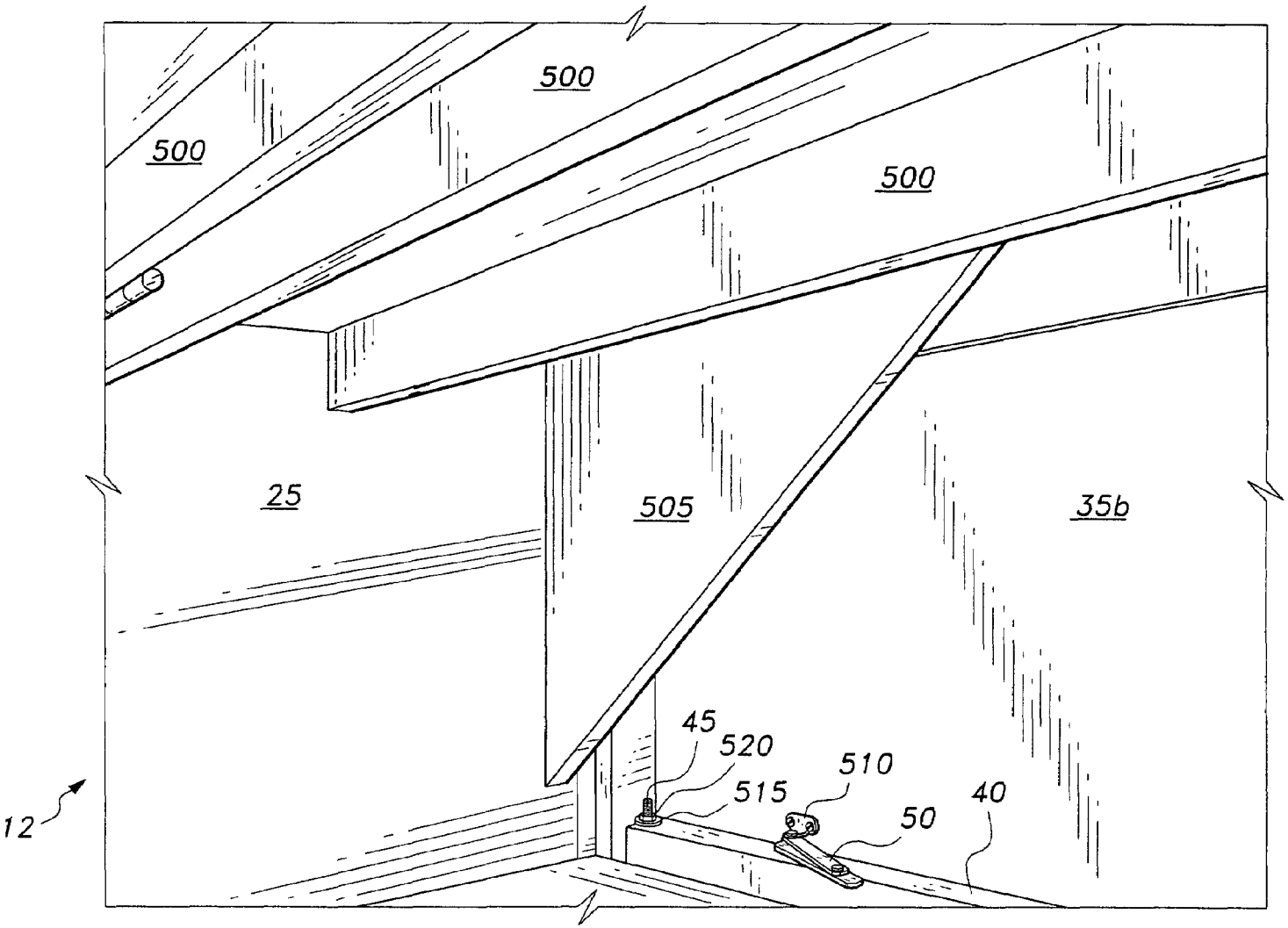
FIG. 5 is a perspective view of the subframe of an article of convertible furniture according to the present invention, showing details thereof.

Two lateral extension sections 35*a* and 35*b*, also having planar surfaces, are pivotally attached to opposing longitudinally extending edges 303 of the bench section 37 so that the lateral extension sections 35*a* and 35*b* can independently swing out from the central bench section 37 to define a bed frame. The pivotal attachment of the extension sections 35*a* and 35*b* to the bench section longitudinal edges 303 may be accomplished using hinges 300. Each of the lateral extension sections 35*a* and 35*b* includes pivotally extendable support legs 40, which provide stability to the respective lateral extensions 35*a* and 35*b* when in the extended configuration. As shown in FIGS. 1-2 and 5, each support leg 40 is pivotally connected to a respective lateral extension section 35*a* or 35*b* using a bolt 45, washer 515 and retaining nut 520. Locking leg brace 50 is pivotally attached to the leg 40 and to connector 510, the connector 510 being fixed to the respective lateral extension section 35*a* or 35*b*.

Figure 6:
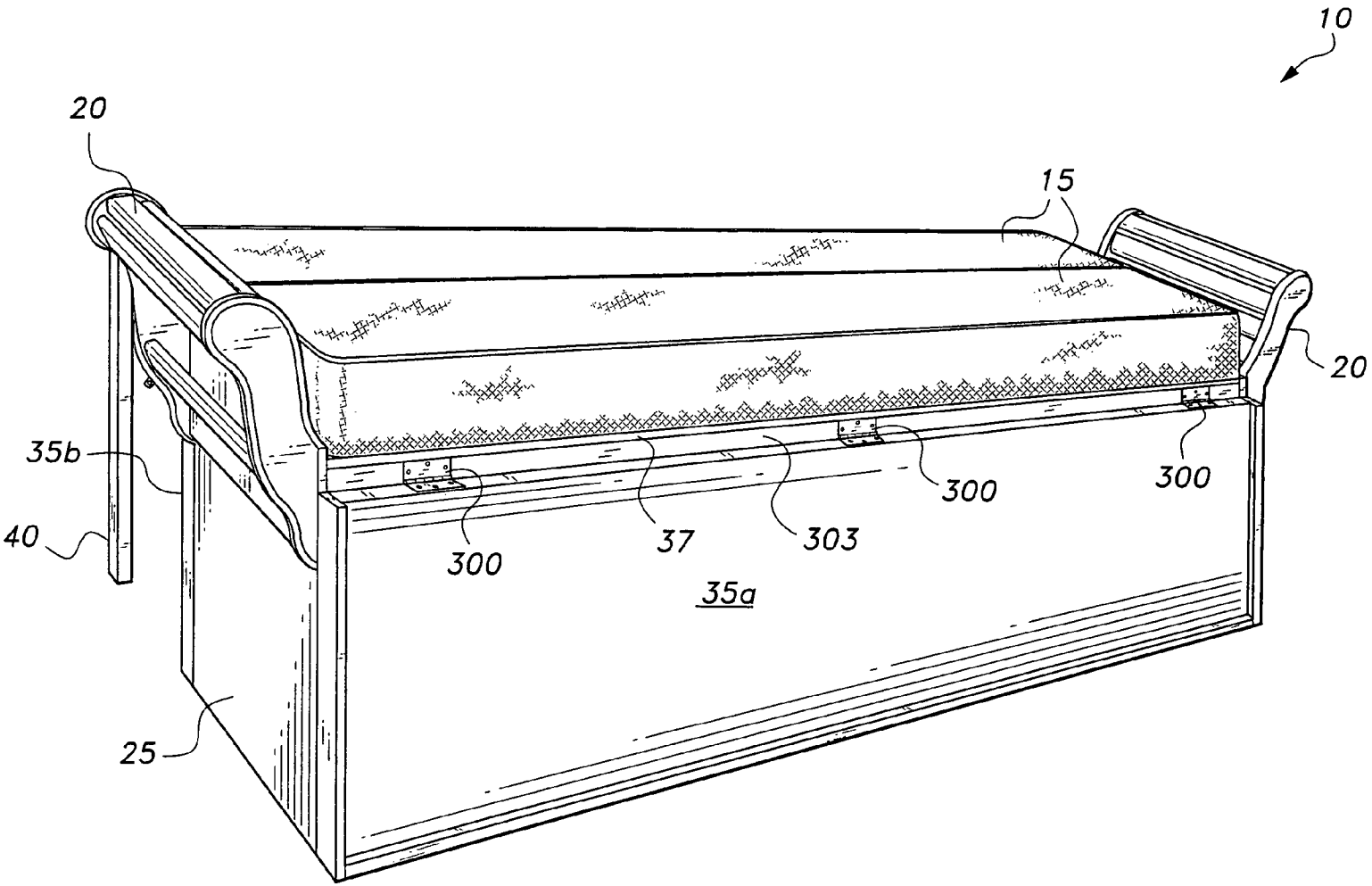
FIG. 6 is a perspective view of the article of convertible furniture of FIG. 1, shown with the bed frame configured for use as a twin bed, two mattresses being disposed thereon.

Referring again to FIGS. 1-4, removable mattresses 15 are provided. Each mattress 15 can lie adjacent to each other on a respective section 35*b*, 37, and 35*a* of the furniture 10 when the extension sections 35*a*, 35*b* are configured to form a bed frame. Since lateral extension sections 35*a* and 35*b* can be retracted and extended independently, the bed size configuration can be custom configured, e.g., to twin size, as shown in FIG. 6, with only one of lateral extension sections 35*a*, 35*b* extended, or to queen size, as shown in FIG. 2, with both lateral extension sections 35*a* and 35*b* extended. Preferably, mattresses 15 are of the box spring-type, although other mattress types, such as foam, air, or the like, are contemplated. Mattresses 15 can be stored in the subframe 12 and hidden from view when the extension sections 35*a* and 35*b* are retracted. An end member 20 is attached to the upper portion of each support member 25 and extends above the plane of the central bench section 37. The end members 20 function as a grab bar for moving the article of convertible furniture 10, as a foot and/or head rest at either longitudinal end of the convertible furniture 10, as an armrest when the convertible furniture is configured as a bench, or as a back rest when the convertible furniture is configured as a chaise or chaise lounge.

As shown in FIG. 5, a plurality of support joists 500 extend between the two load bearing support members 25 within the subframe 12, and are attached to the bottom of central bench section 37 to provide load-bearing support for weight of a user or object sitting on top of bench section 37. Gussets 505 are attached to load bearing members 25 and support joists 500 proximate lateral extension section 35*b* for additional stability. The gussets 505 also prevent items stored in the subframe 12 from impacting lateral extension section 35*b* when it is retracted, and prevent the stored items from inadvertently escaping the subframe 12 when the lateral extension section 35*b* is extended. Preferably structural components of the convertible furniture 10 are made of wood, such as cedar wood. However, structural components can be made of any material that provides sufficient load-bearing capability to support a user lying or sitting on the article of convertible furniture 10.

It is to be understood that the present invention is not limited to the embodiments described above, but encompasses any and all embodiments within the scope of the following claims.

I claim:

1. An article of convertible furniture, comprising:

an elongate planar member having upright load-bearing support members at opposite ends thereof, the planar member and support members forming a subframe;

an elongate central bench section having a planar surface and opposing longitudinally extending edges, the central bench section being attached at opposite ends thereof to the subframe support members;

first and second elongate lateral extension sections, each having a planar surface, opposite ends and opposing longitudinally extending edges, wherein one of the longitudinally extending edges of each of the extension sections is pivotally attached to the opposing longitudinally extending edges of the bench section, respectively, the extension sections pivoting between a retracted position against the subframe support members when configured as a bench or chaise and an extended position coplanar with the central bed section to define a bed frame;

a pair of legs pivotally attached to each of the lateral extension sections at the opposite ends, the legs pivoting to an extended position to support the extension sections when the extension sections are in the extended position;

at least three separate mattresses removably disposed respectively on the central bench section and the lateral extension sections, at least one of the mattresses being storable in the subframe when not in use and hidden from view when one of the extension sections is in the retracted position to configure the bed frame to a twin size, and at least two of the mattresses being storable in the subframe when not in use and hidden from view when both of the extension sections are in the retracted position to configure the bed frame to a queen size.

2. The article of convertible furniture according to claim 1, wherein the elongate central bench section is rectangular in shape.

3. The article of convertible furniture according to claim 1, wherein the elongate planar member of the subframe is rectangular in shape.

4. The article of convertible furniture according to claim 1, wherein said mattresses comprise box spring mattresses.

5. The article of convertible furniture according to claim 1, further comprising end members attached to an upper portion of the subframe load-bearing support members, the end members alternately providing a head rest, a back rest, and an arm rest.

6. The article of convertible furniture according to claim 1, further comprising a plurality of support joists extending between the subframe load-bearing support members, the joists being attached to the central bench section for supporting a load placed on the central bench section.

7. The article of convertible furniture according to claim 6, further comprising gussets attached to the load-bearing support member and one of thejoists along at least one of the opposing edges of the central bench section.

* * * * *